United States Patent [19]

McClusky et al.

[11] 4,137,689

[45] Feb. 6, 1979

[54] BAG FILLING AND WEIGHING MACHINE

[75] Inventors: Stanley A. McClusky, 5900 Kirkside Ave., Apt. A, Bakersfield, Calif. 93309; Jerry L. Boyd, Bakersfield, Calif.

[73] Assignee: Stanley A. McClusky, Bakersfield, Calif.

[21] Appl. No.: 840,324

[22] Filed: Oct. 7, 1977

[51] Int. Cl.[2] ..... B65B 1/32; B65B 43/26

[52] U.S. Cl. ..... 53/502; 53/570; 141/166

[58] Field of Search ..... 53/59 W, 187, 188, 190; 141/129, 166; 198/842

[56] References Cited

U.S. PATENT DOCUMENTS

| | | | |
|---|---|---|---|
| 3,091,903 | 6/1963 | Kammerer | 53/187 X |
| 3,416,620 | 12/1968 | McClusky | 53/59 W X |

*Primary Examiner*—Travis S. McGehee

*Attorney, Agent, or Firm*—Poms, Smith, Lande, Glenny & Rose

[57] ABSTRACT

A bag filling and weighing machine including an endless conveyor with bag holding means carried thereby and releasably suspending pliant bags in open condition. The machine includes an intermittently actuated endless conveyor for stopping the bag holding means at a main feed station and dribble feed station for two-stage filling and weighing. Weighing means are located adjacent to, at one side of, and at the approximate level of the endless conveyor means. One side of each bag-holding means is connected to the endless conveyor means and rotatable disc means concentric with conveyor sprocket means are provided for supporting bag-holder means as the bag holder changes direction around the end of the endless conveyor means. A novel driving and mounting connection for a bag holder to a single drive chain.

15 Claims, 7 Drawing Figures

BAG FILLING AND WEIGHING MACHINE

BACKGROUND OF THE INVENTION

Produce, such as potatoes, onions, brussels sprouts, pears, zucchini, squash, cucumbers, plums and the like, are sold by weight in cardboard cartons, burlap sacks or bags of different size and material. When pliant, flexible bags are filled, the bags are held open by bag holder means which may be connected to a bag holder conveyor means for intermittently positioning a bag holder with its open bag at a filling station. A well-known system for filling bags includes use of two filling stations, the first filling station providing rapid filling of the bag up to about 95% of the selected weight and the second filling station providing a dribble feed for accurately filling the remaining 5% of the selected weight. Such two-stage filling and weighing machines have been disclosed in U.S. Pat. Nos. 2,746,707, 3,073,399, and 3,416,620. The latter U.S. Pat. No. 3,416,620, issued to one of the coinventors herein, describes such a machine utilizing a plurality of bag holders and a conveyor means having spaced connections to each bag holder along a diameter of the bag holder which lies in the direction of travel of the conveyor means.

In the filling and weighing of bags with such produce, it is desirable that certain modifications in a machine be readily made to most efficiently fill and weigh bags with a particular produce. It is also desirable that spillage of such produce during filling be reduced to a minimum and preferably eliminated because such spillage may lodge in other parts of the machine and may result in treacherous footing for an operator. It is also desirable that space beneath the bag conveying portion of the machine be free from obstructions so that it may be readily cleaned when necessary and so that the insertion of bags on the holders and the weighing of such bags may be accomplished without interference from machine structure. It is also desirable that the weighing scale devices be readily available for adjustment and replacement in the event the filling of the bags is to be changed from a weight system to a volumetric system. Also, different produce may require different systems for the most efficient feeding of such produce to the bag holders and bags carried thereby.

Such bag filling and weighing machines are required to be rapidly operated in order to effectively and efficiently bag a great number of sacks in a limited period of time. In such prior proposed mechanized systems the number of bags filled and ready for shipment per hour depends upon the completion of all of the separate bagging operations. Obviously, the total number of bags filled per hour and ready for shipment will be limited to that part of the machine or system which operates the slowest. In general, such systems include the steps of sizing the produce, conveying the sized produce to a feeding device for feeding the produce in bulk and in discrete separate individual pieces of produce, filling a bag to a selected weight, transporting the filled bag to a bag closing means such as a sewing head to stitch the top part of the bag closed, and handling and storing the filled, closed bag.

SUMMARY OF INVENTION

The present invention relates to a novel, compact, fast bag filling and weighing machine constructed and arranged to efficiently and effectively serve the needs of a packing house where more than one type of produce is prepared and packaged for shipping or storage.

The invention particularly relates to improvements made upon a two-stage bag filling and weighing machine of the general type shown in U.S. Pat. No. 3,416,620. The invention contemplates a bag filling and weighing machine construction wherein the bag filling machine is so constructed and arranged that structural parts do not obstruct an expanded open top of the bag holder for reception of articles of produce. The construction virtually eliminates spillage from the flow of discrete articles into the bag holders. The bag holders are positioned closely adjacent to each other so that during rapid operation particles cannot lodge between bag holders. The invention contemplates such a bag filling and weighing construction wherein virtually all positions of the bag holders are utilized, except one, for the bag filling and weighing operation. That is, during the intermittent positioning of the plurality of bag holders a step is performed which contributes toward effective rapid operation of the machine. The machne contemplated by the invention is compact, effectively utilizes the space occupied by the machine, and yet is able to fill and weigh 50-pound bags of produce at the rate of between 800 to 1200 bags per hour.

The primary object of the present invention, therefore, is to provide a bag filling and weighing machine constructed and arranged for a most efficient and effective bag filling and weighing operation.

An oject of the invention is to provide a bag filling and weighing machine wherein bag holder means are mounted and carried in a manner which facilitates filling of the bag carried thereby and turning in relatively small radii.

Another object of the present invention is to provide a bag filling and weighing machine made in readily removable and replaceable sections to accommodate different characteristics of different produce.

Still another object of the present invention is to provide a bag filling and weighing machine having a frame construction which supports endless conveyor means in a cantilever fashion.

A still further object of the invention is to provide such machine wherein there is a novel drive connection between the conveyor means and each bag holder means.

Another object of the invention is to provide a bag filling and weighing machine wherein endless conveyor means are connected to each bag holder means through a single link adjacent one side of the bag-holder means whereby parallel lays of the endless conveyor chain means may be positioned relatively closely in order to minimize the width of the conveyor means.

A further object of the invention is to provide a novel support means at opposite ends of the endless conveyor means for guiding the bag-holder means along a single arcuate guideway from one end of a parallel chain lay to the adjacent end of the adjacent chain lay.

The present invention contemplates a bag-holder means having a single attachment to an endless chain means and supported and arranged with respect to bulk and dribble feed stations such that there is virtually no structural obstruction to the feeding of articles from the bulk and dribble feed conveyor means.

Various other objects and advantages of the present invention will be readily apparent from the following description of the drawings in which an exemplary embodiment of the invention is shown.

Figure 1:
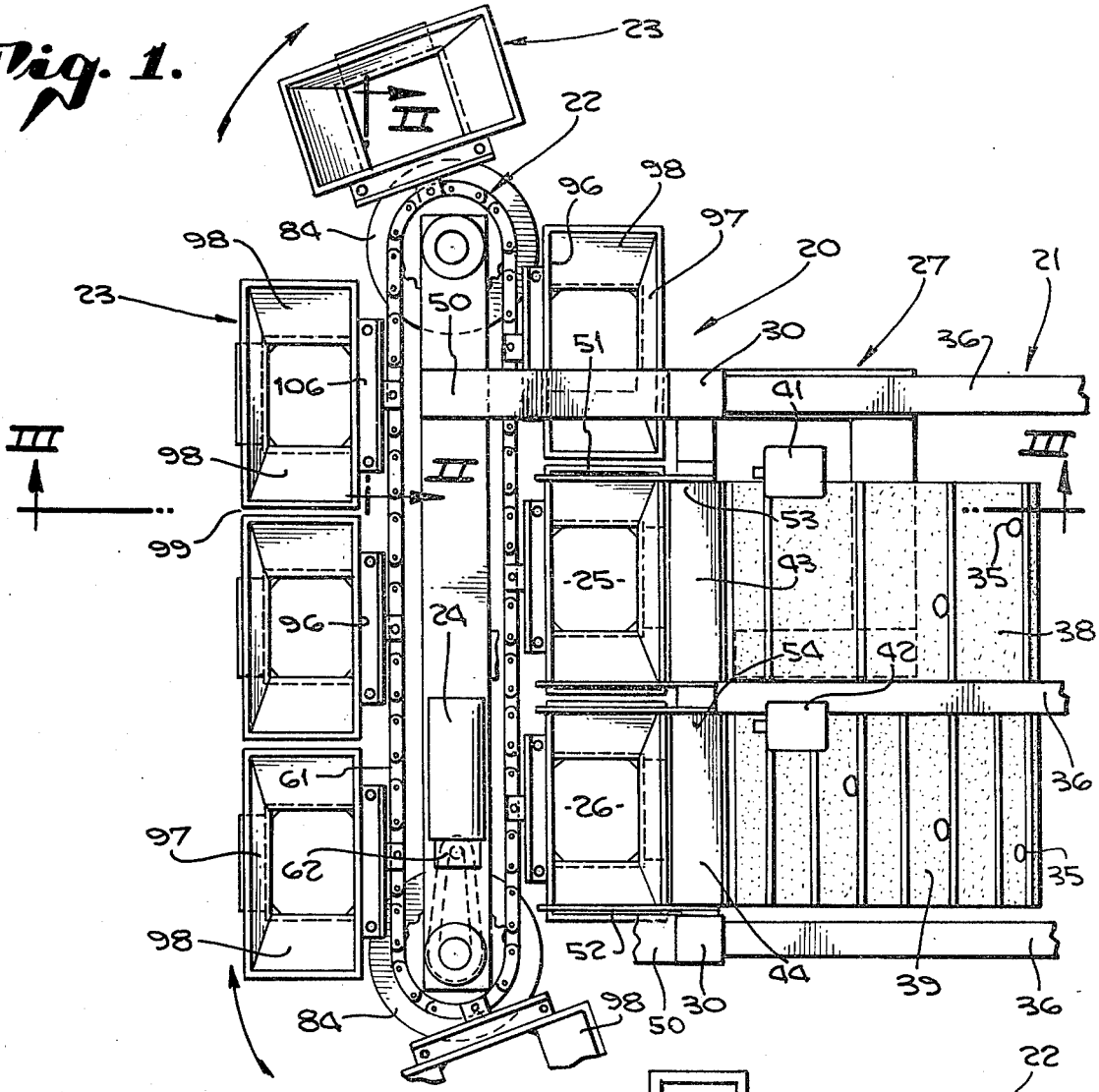
FIG. 1 is a fragmentary partial top plan view of a bag filling and weighing machine embodying the present invention.
Figure 2:
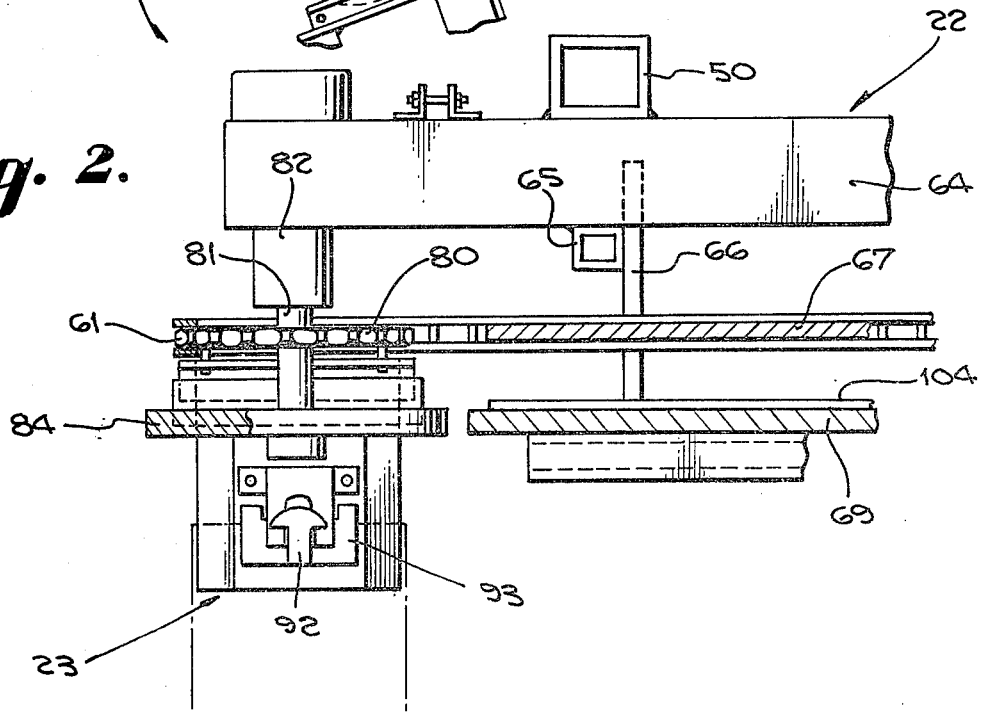
FIG. 2 is a fragmentary enlarged sectional view taken in the vertical plane indicated by line 2 of FIG. 1.

A bag filling and weighing machine embodying this invention is generally indicated at 20. Machine 20 may be constructed and arranged in three units:

a frame unit 21, a conveyor unit 22, and bag or sack holder means 23. Operating and control means are provided in a control unit 24. Control unit 24 has electrically associated with it the necessary electrical equipment for operating several limit switches for regulating the intermittent actuation of the conveyor means, control of the main bulk and dribble feed conveyors through response of the two-stage weighing stations 25 and 26. The control means is essentially the same as that shown and described in U.S. Pat. No. 3,416,620.

Frame means 21 may comprise a plurality of upstanding columns 30 of square tubular section interconnected by horizontal transverse members 31. Extending from one side of columns 30 are horizontal beams 33 connected to vertical legs, suitable transverse members, and diagonal braces 36 to provide a framework for supporting a main bulk feed conveyor 38 and a dribble feed conveyor 39. The feed conveyors 38 and 39 are inclined upwardly, are supported at their ends from the framework in suitable manner, and each is driven by a separate independently controlled motor means 41 and 42 positioned near the top of respective feed conveyors for driving feed conveyors 38 and 39. Suitable side walls of sheet metal are provided for each conveyor, such sidewalls terminating adjacent the vertical plane of columns 30. At the lower intake end of inclined feed conveyors 38 and 39 an enlarged hopper or reservoir means (not shown) is provided for discrete articles 35 which may be fed into the hopper by suitable supply conveyor means. Feed conveyors 38 and 39 are provided with cleats on their outer surfaces for picking up and carrying upwardly a quantity of discrete articles for discharge along a downwardly inclined apron 43, 44 to direct articles into the bag holder and bag carried thereby. This arrangement of upwardly inclined and then downwardly inclined bulk and dribble feed conveyors may be essentially the same as that shown in U.S. Pat. No. 3,416,620.

Extending from the opposite side of the plans of the columns 30 are spaced cantilever beams 50 which may be suitably secured by welding to the upper portion of columns 30. Cantilever beams 50 serve to support at one side of vertical columns 30 the conveyor means unit 22 for carrying and moving bag holder means 23.

In alignment with walls of the bulk and dribble feed conveyors 38 and 39 and extending from the side of columns 30 opposite to said conveyors may be provided U-shaped walls 51 and 52 in alignment with walls of feed conveyors 38 and 39 for providing a feed opening or throat 53, 54 for articles of produce discharged from the feed conveyors to fall into a bag holder and sack carried thereby and positioned therebeneath at a main bulk feed station 25 and dribble feed station 26.

Conveyor means unit 22 is adapted to be separately constructed for ready attachment to frame means 21. Conveyor means unit 22 includes a conveyor frame structure 60 on which is mounted a conveyor chain means 61, a motor 62 to drive said chain means, track means 63 for the bag holder means 23 and scale means for the bulk feed station and the dribble feed station.

Conveyor frame structure 60 comprises a square section tubular beam 64 connected by suitable means to cantilever beams 50 adjacent their outer ends. Beam 64 extends longitudinally of the conveyor means 22 and lies transversely to the fed conveyors 38, 39. Beam 64 carries a plurality of spaced cross arms 65 from which may depend inboard vertical members 66 which support parallel longitudinally extending guideways 67 for the conveyor chain 61. Vertical members 66 may extend downwardly to carry inboard guideways 69 for the bag holder means 23. On the outboard side of the outer path of the conveyor means downwardly extending outboard straps 70 support an outboard guideway 71 for the bag holder means. On the opposite side, horizontally extending frame member 31 may support a guideway 73 for the row of bag holding means 23 at portions of the inner path of bag holder means not supported by bulk feed scale means and dribble feed scale means as later described.

Conveyor means 60 includes endless chain means 61 made of a plurality of pivotally interconnected links 75 with rollers 68 between the links 75. At spaced intervals along chain 61 top and bottom guide lugs 76 are mounted on said link chain and extend inboardly to slideably embrace the horizontal longitudinally extending guideways 67, thereby locating the guide chain 61 at a selected elevation in the machine 20. Angle section members 78 may be secured as by welding to cross arms 65 and extend longitudinally parallel to each run or lay of the chain means 61 with the depending leg of the angle section vertically overlying chain means 61 for protection and to assure continuous sliding engagement with guideway 67.

At opposite ends of the endless chain means 61 and rotatably supported from beam 64 is a sprocket wheel 80 for meshed engagement with the chain means 61. Sprocket 80 is carried on a shaft 81 suspended in suitable bearings in a bearing housing 82 carried at ends of beam 64. At one end of conveyor means 60, sprocket shaft 81 is connected by suitable drive means to motor means 62 for driving engagement of the conveyor chain 61.

Means for supporting and assisting bag holder means 23 around each end of endless conveyor means 60 comprises a circular flat disc 84 carried by a downward extension of shaft 81 and supported in suitable manner with the upper surface of disc 84 lying in the same plane as the top surface of guideways 69. The diameter of the guide disc 84 is greater than the sprocket 80 to provide supporting engagement for the bag holder means as hereinafter described. The guide disc 84 may be made of any suitable material such as wood or metal.

Figure 5:
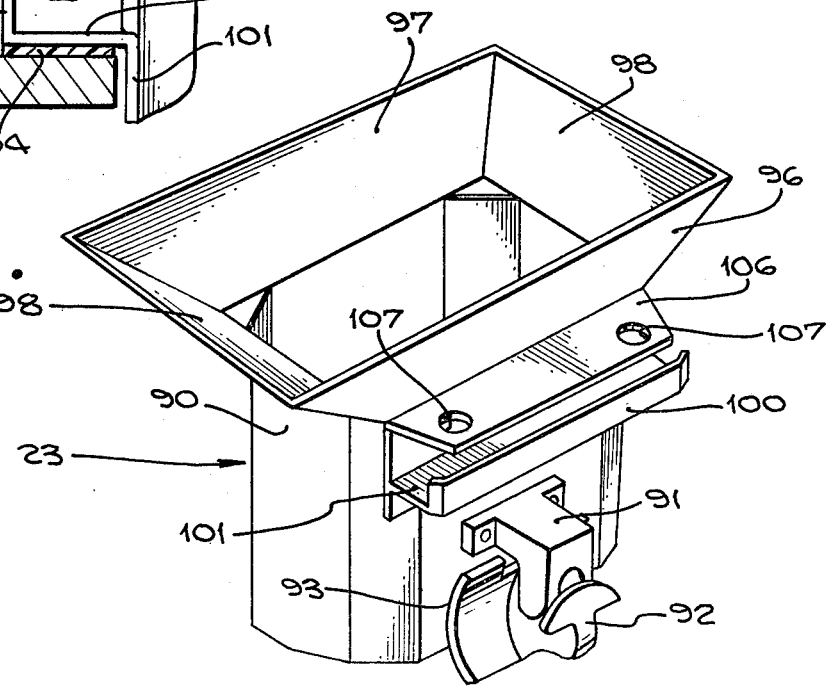
FIG. 5 is a perspective view of a bag holder means embodying the present invention.

Bag holder means 23, FIG. 5, may comprise a tubular open ended member 90 of octagonal cross section and made of suitable metal. On inboard and outboard walls of each tubular member 90 is provided a clamp device 91 having a pivotally mounted weighted clamp member 92 having an acruate sack engaging surface 93 for clamping and holding engagement with a sack 94. The weighted clamp members 92 permit the upward ensleeving of the top open end of a sack 94 over the lower portion of the tubular member 90 and as the sack is released, the clamp members frictionally engage and clamp the top portion of the sack against the tubular member 90. The weighted clamp members are gravity or automatically actuated into holding engagement.

The upper portion of tubular member 90 is provided with an expanded or extended fill opening which facilitates the guiding reception of articles into the member 90 and into the sack 94. Inboard wall of member 90 is extended upwardly in the same plane to provide an inboard vertically disposed wall 96. Opposite wall 96 there is provided an outboard inclined wall portion 97. At opposite ends of the opening, the walls 96 and 97 are joined together by outwardly inclined end wall portions 98. Thus, an enlarged funnel shaped opening is provided for tubular member 90. Interior surfaces of said wall portions 96, 97, 98 may be provided with a lining of cushion-like material such as foam plastic to prevent bruising of articles as they are fed into the bag holder means and sack.

It should be noted from FIG. 1 that the end inclined walls 98 of adjacent bag holder means 23 are in close proximate relation as at 99. Thus, when the bag holder means are positioned respectively at the bulk and dribble feeding stations 25, 26, the jumping of one article from one delivery feed to the other will result in the article falling into a sack or bag instead of being spilled onto the floor or lodged in another part of the apparatus.

Each bag holder means 23 is provided on each inboard and outboard wall with a Z section member 100, leg 101 of said Z member being welded to the wall of body member 90. The middle portion 103 of the Z bar is horizontally arranged and is adapted to slide on guideways 69 or 70 and 73. A strip 104 of antifriction materials such as Teflon or delrin may be secured to the guideways to facilitate sliding movement of the bag holder means along the guideways.

Means for connecting each bag holder means 23 to the chain means 61 of the conveyor means includes an angle section connecting and driving member 106 welded to the wall of the member 90 just above the inboard Z section member 100. Each angle member 106 includes spaced holes 107, each for loose reception of a driving pin 108 which is carried by an angle section drive member 109. Intermediate ends of the drive member 109, the upstanding leg 110 thereof may be secured as by welding to top and bottom link elements 75 of the chain 61. The upper link element 75 has an inboardly extending extension 111 with an upturned end lip 112 which serves as a switch actuator member.

Figure 3:
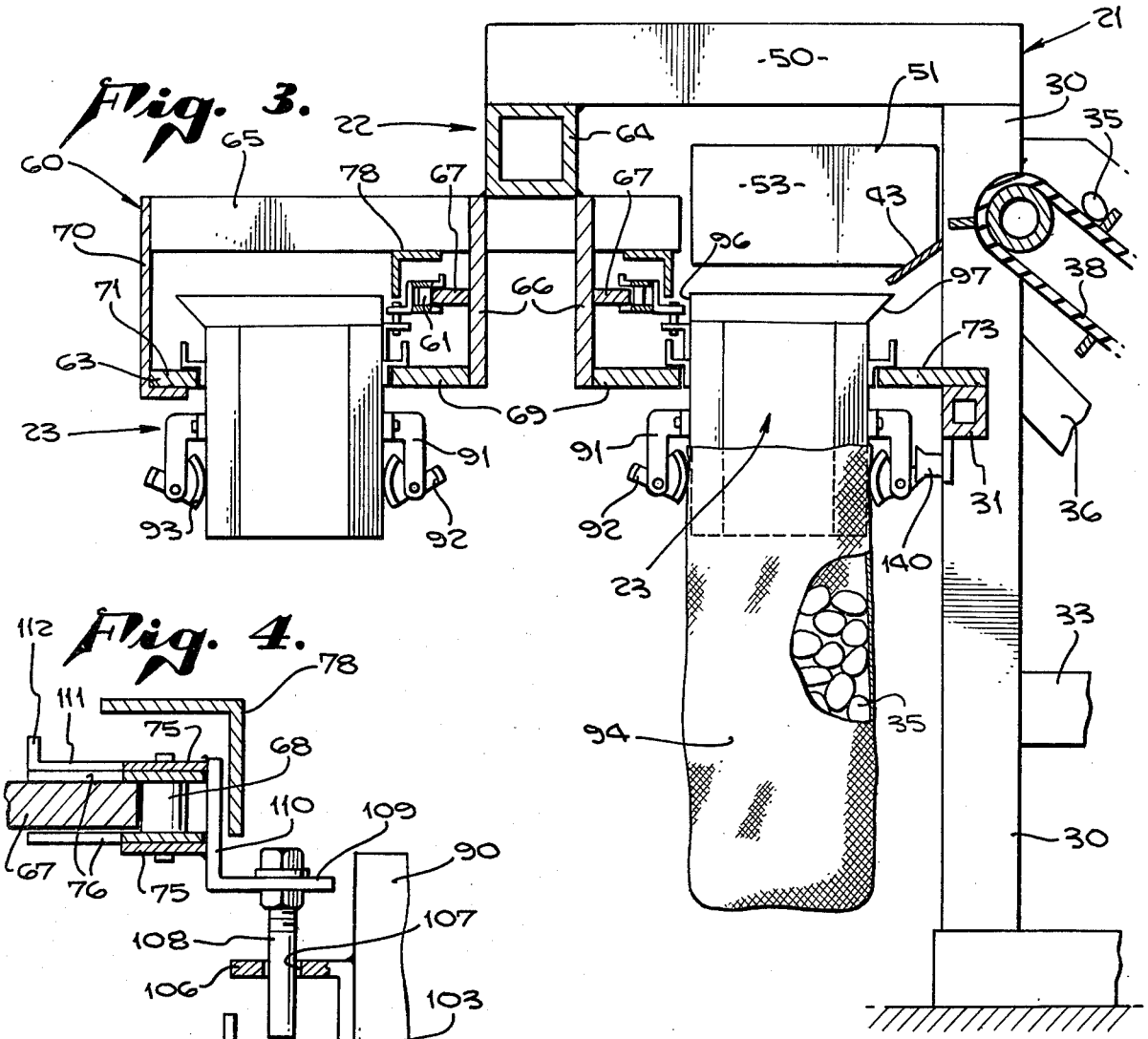
FIG. 3 is a fragmentary enlarged sectional view taken in a vertical transverse plane indicated by the line 3—3 of FIG. 1.
Figure 4:
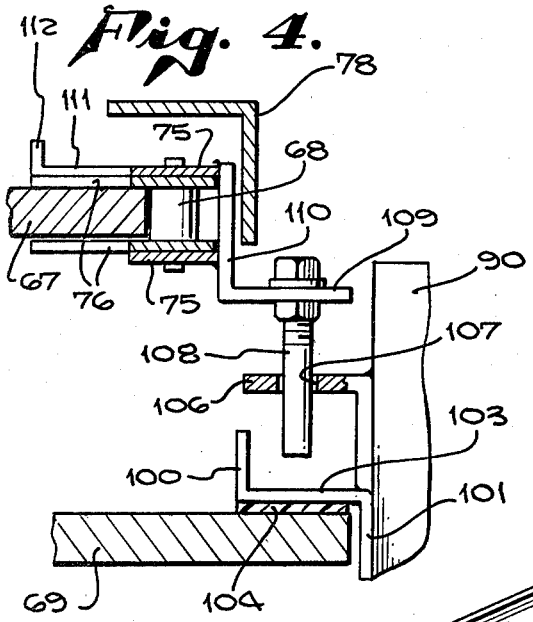
FIG. 4 is an enlarged fragmentary sectional view of the driving connection between endless chain means and a bag holder means, the section being taken in the same plane as that of FIG. 3.

It will be apparent from the above description that each bag holder means 23 is supported on opposite sides thereof along parallel runways or paths of conveyor means 60 and that each bag holder means 23 has a single connection, inboardly only, to chain means 61. Since this connection to chain means 61 is inboard of the inboard wall 96 of bag holder member 90, it will be apparent that the opening defined by the top outwardly flared portions 97 and 98 of each bag holder means is unobstructed by any part of the conveyor means as best seen in FIG. 3. Unobstructed flow of articles into the expanded receiving opening of bag holder members and sacks carried thereby is thereby provided.

The driving connection to chain means 61 at the inboard side of the bag holder means 23 is maintained as the drive chain moves around end sprockets 80. To further support bag holder means 23 during its change of direction at ends of conveyor means 60, discs 84 provide circular or arcuate upwardly facing surfaces which are engaged by the horizontal intermediate portion 103 of Z section member 100 carried on the inboard wall of bag holder means 23. Disc 84 rotates at the same speed as sprocket 80 and therefore supports and assists the bag holder means in making its 180° turn at the end of the conveyor means. It will be noted that when bag holder means 23 leaves the parallel way means 69, the bag holder means will be supported solely by disc 84 and by its connection to the chain means 61. The employment of a relatively long Z bar 100 for support of the bag holder means on the parallel way means is advantageous in that each Z bar 100 will be slideably engaged with the parallel way means 69 before the Z bar leaves its engagement with the upper marginal surface of rotatable disc 84. Thus, the bag holder means 23 are adapted for connection to sprocket and support discs of relatively small diameter to enhance the compactness, that is the narrowness of, the conveyor means 60 and to facilatate rapid operation of the conveyor means.

Figure 6:
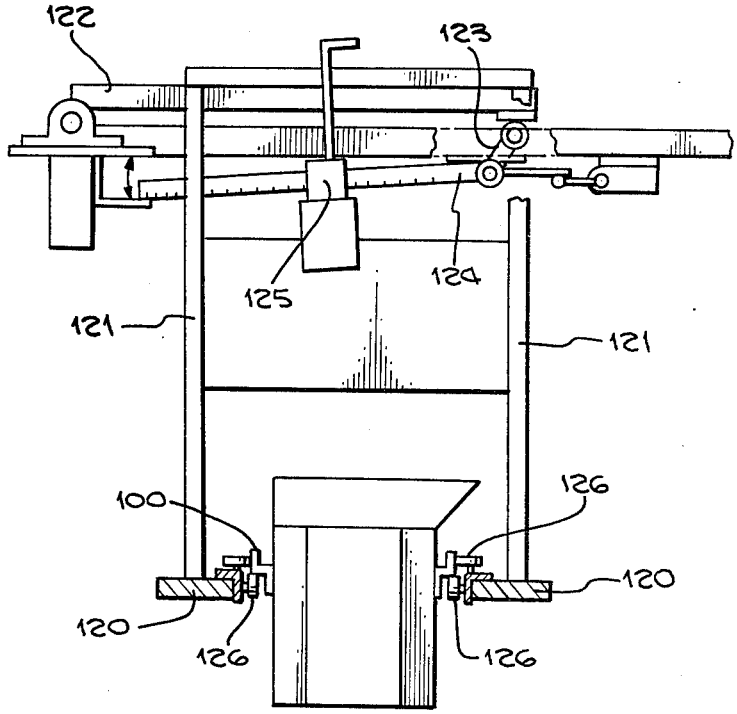
FIG. 6 is a fragmentary elevational view of bulk weighing means associated with the machine shown in FIG. 1.
Figure 7:
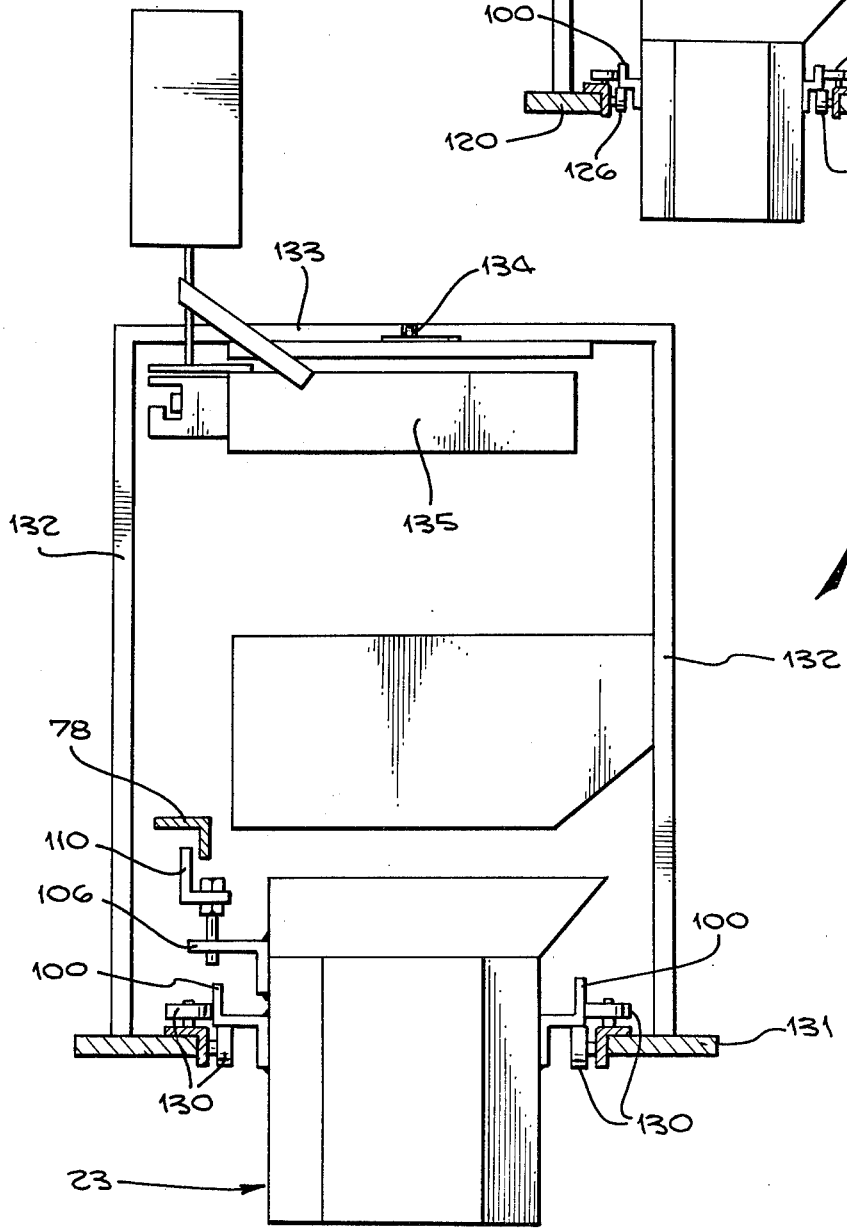
FIG. 7 is a fragmentary elevational view showing dribble feed weighing means associated with the machine of FIG. 1.

Means for weighing the partially filled and filled sacks at the bulk and dribble feeding stations is somewhat similar to that shown in U.S. Pat. No. 3,416,620. At bulk filling and weighing station 25, a portion of way means 69 and 73 is broken away and replaced by a scale segment 120, FIG. 6, on opposite sides of the bag holder means. Each weighing segment 120 carries rollers 126 arranged at 90° to each other and is connected by upright bar 121 to a pivotally mounted weigh beam 122 which exerts the weighing force through a pivotally connected link means 123 to a counterweight arm 124 having a slideable weight 125 thereon for counterbalancing and for roughly setting the beam scale to a predetermined preweight condition, as for example, a 95% filled sack at the bulk feeding station.

In similar manner at the fine or dribble feed scale means, a portion of the way means 69 and 73 is removed and rollers 130 arranged at 90° to each other, support and guide the bag holder means 23 on a weigh bar member 131, which is connected through vertical members 132 to a top member 133 which has a pin connection 134 for transmitting the weight carried by the bar members 132 to a scale body 135. Thus, as the partially filled bag moves to the dribble feed station, the bag holder means is supported on wheels 130 and as articles are fed to the sack one by one, the weight thereof is transmitted to the scale body until the selected finished weight is reached.

Operation of the bag filling and weighing machine is similar to that described in said U.S. Pat. No. 3,416,620. Empty bags are slipped on the bag holder means at four bag feeding stations located on the side of the machine opposite the article feed conveyors. As the conveyor means intermittently advances the bag holder means, the bags will be intermittently stopped at the bulk feed and dribble feed stations for filling. At the bulk feed station approximately 95% of the weight of the bag is rapidly fed into the bag. At the same time at the dribble feed station articles are being fed one by one into the almost filled bag to bring it to its proper weight condition. When both bags have been filled to their selected weight, the conveyor means advances the completely filled bag to a bag release point which is located just before the bag holder makes its turn at one end of the conveyor means.

In this machine, the bag release is automatically performed by a cam wheel 140 (only one shown in FIG. 3) carried by frame 21 which engages the clamp member 92 on opposite sides of the bag holder and thereby releases the bag to fall a short distance upon a suitable conveyor which will transport the filled bag to a bag sewing machine (not shown). The intermittent advancement of the conveyor means and the bag holder means continues to fill bags in a very rapid manner.

Switch means, not shown, are provided to prevent advancement of the conveyor means in the event a bag is not sensed at the bag holder means immediately prior to the main bulk feeding station. If such an omission of a bag occurs, the machine stops and will not advance bags until a bag is supplied to the empty bag holder means.

In the above described machine, the conveyor unit 22 may be readily fabricated as separate unit adapted to support and convey a selected size of bag holder and may be readily attached to the frame unit 21 at suitable points because of the cantilever construction of the frame means 21. The frame unit 21 may require certain modifications in the bulk and dribble feed conveyor means for different types of articles and such frame means or the individual bulk and dribble feed conveyor units may be replaced for a conveyor unit of desired characteristics to handle certain articles. Thus, the generally identified three unit parts of the machine may be readily modified for specific packing house operations without reconstruction of an entire machine.

The compactness and relatively narrow width of the conveyor unit 22 reduces the space required for installation of such a machine in a packing house, yet the efficiency or rate of bagging capability of the machine is not sacrificed by such reduction in size.

It will be understood that various accessories may be associated with the machine, for example a bag vibrator, without costly extensive modification of the machine because of the arrangement of the frame unit 21 and conveyor unit 22.

Various modifications and changes may be made in the bag filling and weighing machine as described above and which come within the spirit of this invention and all such changes and modifications coming within the scope of the appended claims are embraced thereby.

We claim:

1. In a bag filling and weighing machine for discrete articles, such as produce; the combination of:

a frame means;

a plurality of bag holders;

means on said frame means to intermittently move said bag holders in an endless path;

means on said frame means to support said bag holders along said path;

said support means including parallel guide ways at opposite sides of said bag holders for a portion of said path, and a single arcuate guide way for one side of each of said bag holders at ends of said parallel guide ways to support said bag holders during a change in direction of said endless path;

said means to move said bag holders including a driving yieldable connection to one side of each bag holder.

2. In a machine as stated in claim 1 wherein said single arcuate guide way is rotatable about an axis.

3. In a machine as stated in claim 2 wherein said single arcuate guide way includes a rotatable disc.

4. In a machine as stated in claim 1 wherein;

said moving means includes sprockets of selected diameter at opposite ends of said endless path;

said single arcuate guide way includes a circular disc having a diameter greater than said selected sprocket diameter and rotatable about the same axis as said sprocket.

5. In a machine as claimed in claim 1 wherein each bag holder includes an open ended tubular body, and parallel guide support members on opposite sides of said body cooperable with said guide ways on said frame means.

6. In a machine as stated in claim 5 wherein said driving connection includes a driving member carried by said tubular body above one of said guide support members, and a drive member connected to said moving means and parallel to said connecting member on said tubular body.

7. In a machine as stated in claim 6 wherein said driving connection includes a single connection to said moving means intermediate ends of said driving member;

and a vertically yieldable connection to said drive member on said tubular body.

8. In a machine as stated in claim 1 wherein said frame means includes a cantilever supported beam extending along said endless path for supporting said support means for said bag holders and said moving means for said bag holders.

9. In a machine as claimed in claim 1 wherein said moving means includes an endless chain, a chain guide member on said frame means;

and top and bottom inboardly extending lugs slideably engaging and embracing edge portions of said chain support member along said portion of said path.

10. In a bag filling and weighing machine including independently actuatable main article feed means associated with a first weighing station means, and independently actuatable dribble article feed means associated with a second weighing station means, and means for movement of bags from said weighing station only after each bag is filled to a predetermined weight, bag conveying means for transporting bags to and from the weighing stations, bag holder means operatively engaging a bag conveying means for transportation thereby, and cooperable support means on said bag holder means and on a conveyor frame structure, the improvement comprising:

means for vertically yieldably connecting one side of each holder means to said conveying means;

said cooperable support means having movement corresponding to movement of said conveyor means for supporting said one side of said holder means during change in direction of said conveying means.

11. In a machine as stated in claim 10 wherein said means having movement corresponding to said movement of the conveyor means includes a member movable at the same rate of speed as said conveyor means.

12. A machine as stated in claim 11 wherein said movable member includes a rotatable disc having an edge margin cooperable with said support means on said bag holder means.

13. In a bag filling and weighing machine for discrete articles, such as produce; the combination of:

a frame means;

a plurality of bag holders, each bag holder having an elongated support element;

means on said frame means to move said bag holders in an endless path;

means on said frame means cooperable with said support element to support said bag holders along said path;

said support means including an arcuate support member for one side of said bag holder cooperable with said support element and movable therewith during a change in direction of said endless path.

14. In a machine as stated in claim 13 wherein said arcuate support member is movable at the same rate of speed as said moving means.

15. In a machine as stated in claim 13 wherein said means to move said bag holders includes a driving connection at one side of each bag holder.

* * * * *